United States Patent [19]

Down

[11] Patent Number: 4,912,911

[45] Date of Patent: Apr. 3, 1990

[54] MACHINE FOR STRETCH WRAPPING OF LARGE REELS OF PAPER AND OTHER MATERIALS

[75] Inventor: Francis I. Down, New South Wales, Australia

[73] Assignee: G.D. Engineering Pty. Limited, Merrylands, Australia

[21] Appl. No.: 239,958

[22] PCT Filed: Oct. 13, 1986

[86] PCT No.: PCT/AU86/00303

§ 371 Date: Jun. 10, 1988

§ 102(e) Date: Jun. 10, 1988

[87] PCT Pub. No.: WO88/02723

PCT Pub. Date: Apr. 21, 1988

[51] Int. Cl.[4] ..... B65B 11/04

[52] U.S. Cl. ..... 53/465; 53/64; 53/211; 53/587; 53/389

[58] Field of Search ..... 53/556, 587, 211, 399, 53/441, 465, 64, 389

[56] References Cited

U.S. PATENT DOCUMENTS

| | | | |
|---|---|---|---|
| 1,588,930 | 6/1926 | Ashmead | 53/587 |
| 1,654,258 | 12/1927 | Hooper | 53/587 X |
| 3,928,939 | 12/1975 | Edwards et al. | 53/465 |
| 4,184,307 | 1/1980 | Kataoka | 53/380 |
| 4,281,500 | 8/1981 | Mueller et al. | 53/211 |
| 4,565,051 | 1/1986 | Back | 53/556 X |
| 4,590,746 | 5/1986 | Humphrey | 53/587 X |

FOREIGN PATENT DOCUMENTS

| | | |
|---|---|---|
| 19714/67 | 10/1968 | Australia . |

*Primary Examiner*—John Sipos

*Attorney, Agent, or Firm*—Oblon, Spivak, McClelland, Maier & Neustadt

[57] ABSTRACT

A machine for wrapping cylindrical rolls of paper wound on a reel having a central core has a loading conveyor and vertically adjustable drive rolls which raise the reel so that its longitudinal axis is placed on an axis of rotation of the wrapping machine. A wrapping head winds wrapping material endwise around the paper roll which is rotated about its longitudinal axis during the wrapping operation by the drive rollers. The wrapping head is tilted at an angle to the vertical so that the endwise wrapping takes place in a plane at an angle to the axis of rotation of the roll so that the wrapping does not cover the ends of the core of the reel.

7 Claims, 5 Drawing Sheets

MACHINE FOR STRETCH WRAPPING OF LARGE REELS OF PAPER AND OTHER MATERIALS

FIELD OF THE INVENTION

This invention relates to machines for wrapping elongated objects such as large reels of web-like material.

For the sake of convenience, the invention will be described in relation to the wrapping of a cylindrical reel of paper using polyethylene or other stretchable film. However, it is to be understood that the invention is not limited thereto as it may be applied to the wrapping of other elongated objects and may be concerned with the wrapping of non-stretchable material over elongated objects.

BACKGROUND ART

It is known to wrap reels of paper in order to protect the paper during transportation and storage. Hitherto, such wrapping has taken place in a wrapping plane containing the axis of rotation of the reel which is rotated whilst the wrapping film is rotated about the reel.

In a conventional paper reel, the paper is wound on an axial hollow core adapted to receive lifting bars or fixing members such as ropes. The disadvantage of known wrapping techniques is that the wrapping film covers all of each end of the reel and thus access to the core is denied.

It is, therefore, an object of the present invention to provide a machine for wrapping elongated objects such as reels of paper wound on a core which leaves access to the axial core.

DISCLOSURE OF THE INVENTION

According to the invention there is provided a machine for wrapping an elongated object such as a cylindrical reel of paper, said machine comprising:

(i) means for loading the object so that its longitudinal axis is placed on an axis of rotation on the machine, (ii) means for rotating the object about the axis of rotation, (iii) a rotating wrapping head adapted to wind wrapping material endwise about the object, (iv) means for tilting the wrapping head so that the endwise wrapping takes place in a plane at an angle to the axis of rotation of the object.

In a preferred form of the invention, a stretchable film such as polyethylene is wrapped around a reel having a central core. The angle of the wrapping plane to the axis of the core is selected according to the reel length and core diameter as well as the width and physical proportion of the wrapping film.

Such a wrapping machine may be constructed in various sizes and configurations and with varying degrees of automatic control.

DESCRIPTION OF PREFERRED EMBODIMENT

Figure 1:
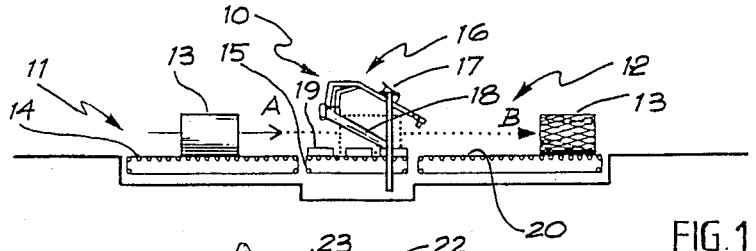
Figure 2:
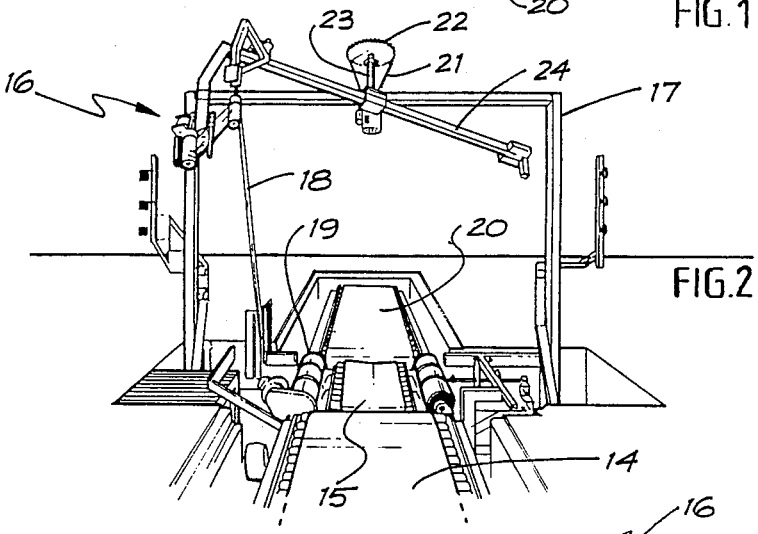
Figure 3:
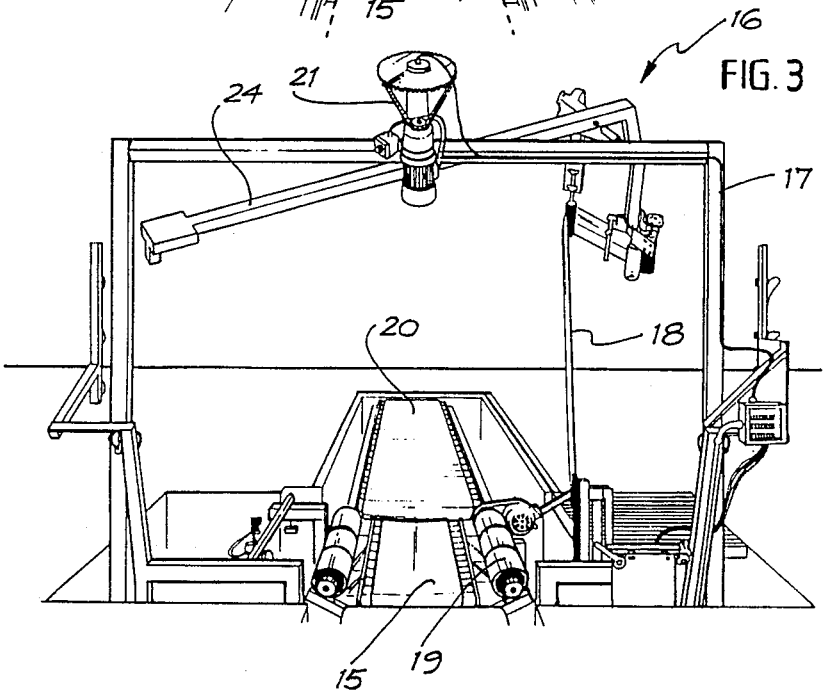
Figure 4:
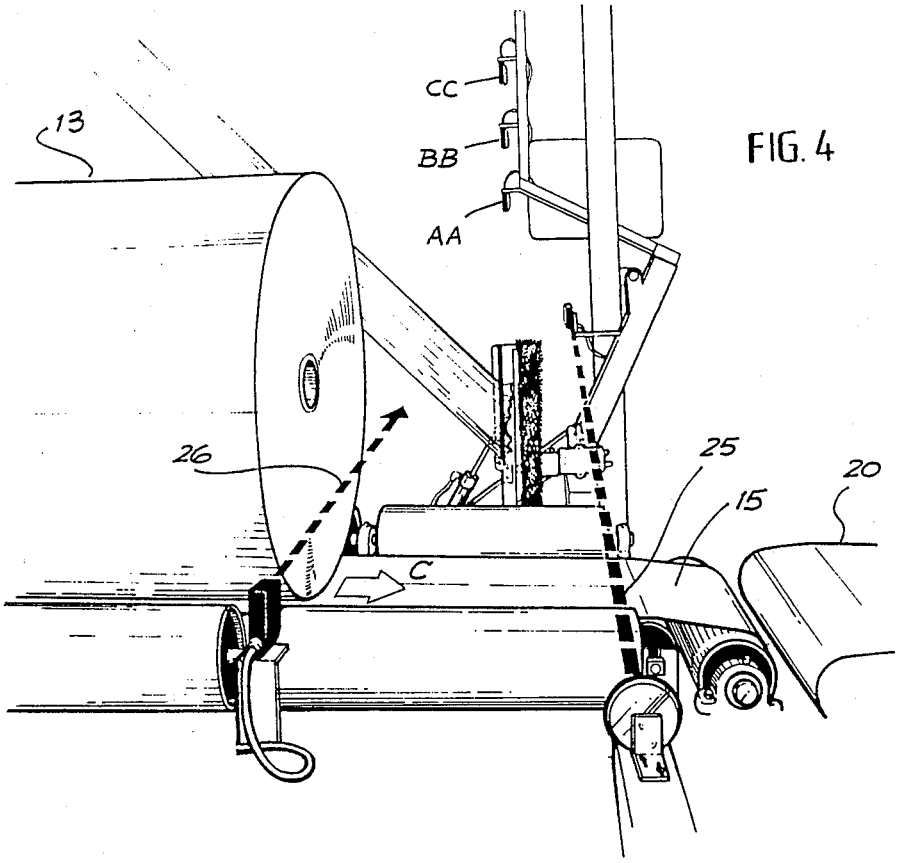
Figure 6:
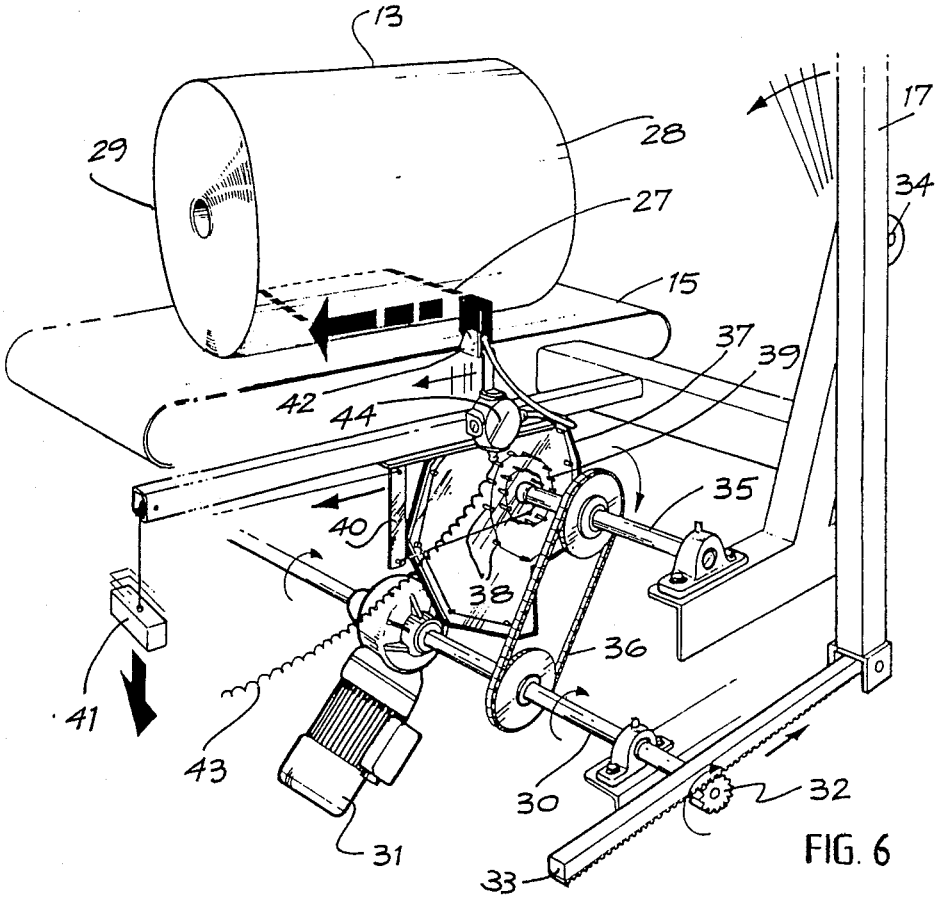
Figure 7:
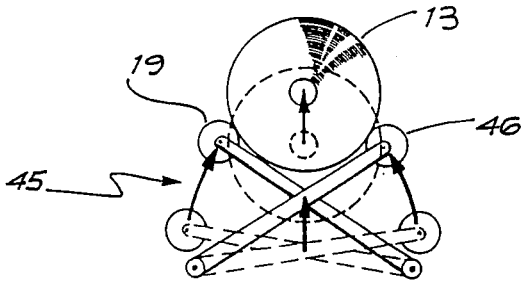
Figure 8:
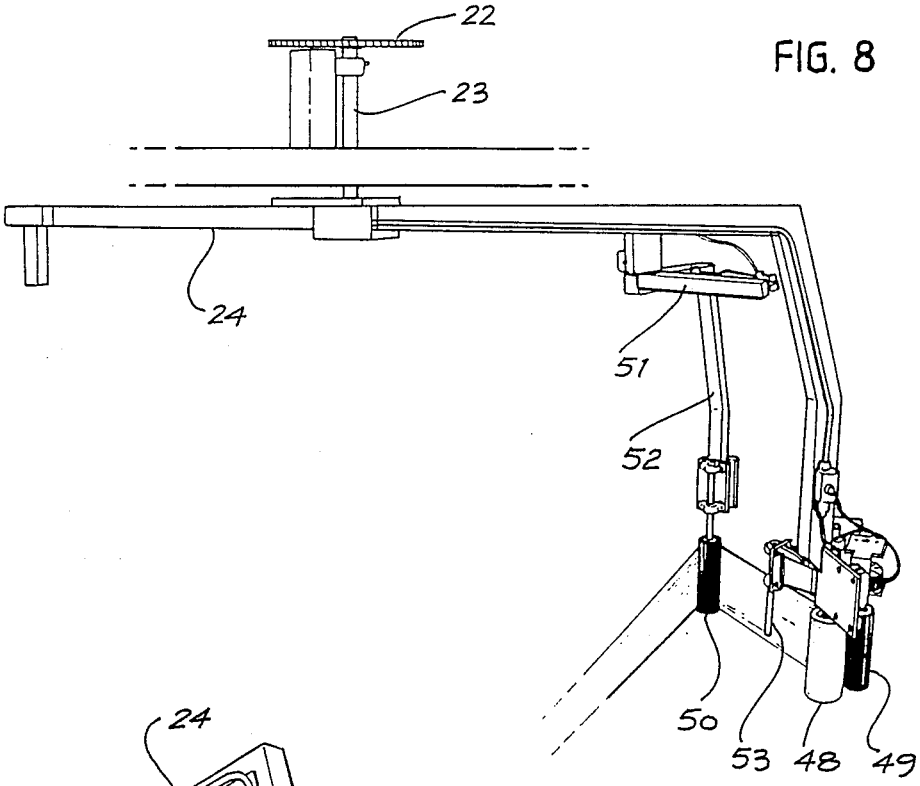
Figure 9:
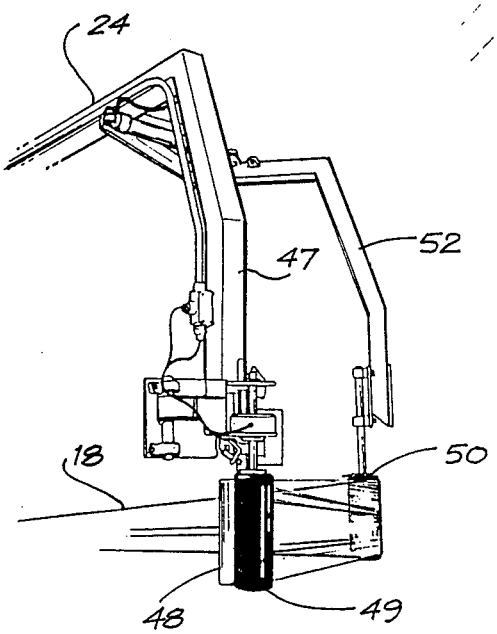
Figure 10:
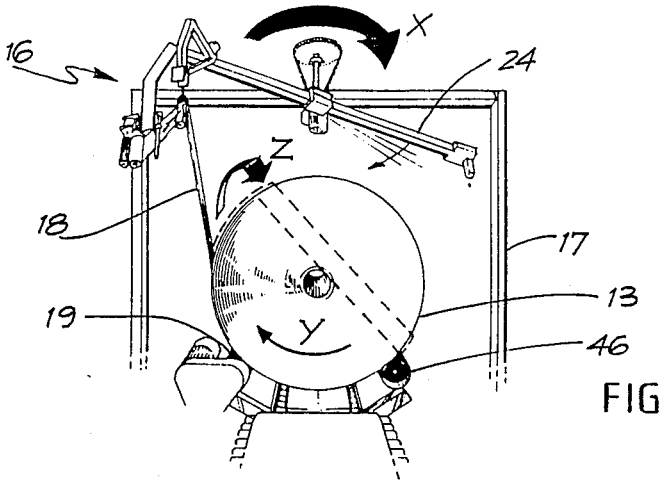
Figure 11:
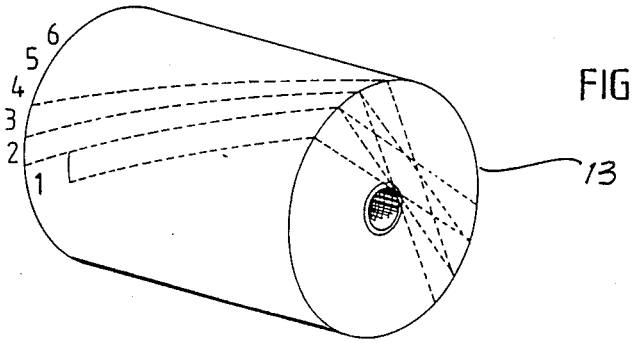
Figure 12:
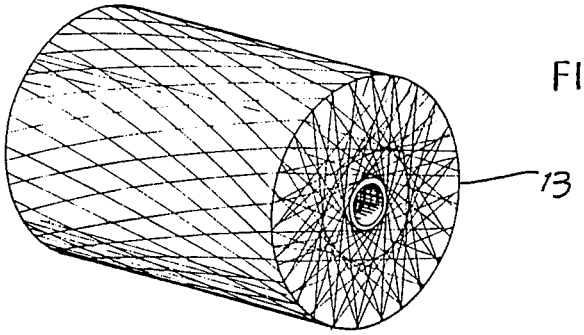

In order that the invention may be more readily understood and put into practice, reference will now be made to the accompanying drawings in which:

FIG. 1 is a side elevational schematic diagram of a wrapping line incorporating a wrapping machine according to one embodiment of the invention, FIG. 2 is an end view from the feed end of the wrapping line shown in FIG. 1, FIG. 3 is an end view from the unloaded end of the wrapping line shown in FIG. 1, FIG. 4 is a cut away, simplified perspective view of the feed control system of the wrapping machine shown in FIGS. 1 to 3, FIG. 5 is a simplified end view of the height adjustment system of the wrapping machine shown in FIGS. 1 to 3, FIG. 6 is a cut away perspective view of the tilting system of the wrapping machine shown in FIGS. 1 to 3, FIG. 7 is a simplified end view of the elevating mechanism of the wrapping machine shown in FIGS. 1 to 3, FIG. 8 is a cut away perspective view of the wrapping arm of the wrapping machine shown in FIGS. 1 to 3, FIG. 9 is a further cut away perspective view of the wrapping arm shown in FIG. 8, FIG. 10 is a simplified end view from the feed end of the wrapping machine shown in FIGS. 1 to 3 with a reel at the commencement of wrapping, FIG. 11 is a perspective view of a reel being wrapped by the wrapping machine of FIGS. 1 to 3 showing the wrapping path, and, FIG. 12 is a view corresponding to FIG. 11 with the reel fully wrapped.

The wrapping machine shown in the drawings is designed to wrap reels of paper of varying diameter and length and as such adjusts automatically to any reel within predetermined dimensional tolerances. It is intended that the wrapping machine be installed downstream from a slitting machine which slits and re-winds from very large reels.

As shown in FIG. 1, the wrapping machine 10 forms part of a wrapping line which includes a reel feed station 11 and a reel unloading station 12. The reel 13 is moved in the direction of arrow A by the feed conveyor 14 and then by the loading conveyor 15 into the wrapping machine 10.

A wrapping head 16 mounted on a tiltable support frame 17 applies a stretchable film 18 to the reel 13 whilst the reel 13 is rotated by rollers 19. When the wrap is complete, the reel is discharged from the wrapping machine 10 onto the unloading conveyor 20 in the direction of arrow B.

The wrapping head 16 is rotated by a belt 21 which passes around driven pulley 22 mounted on a spindle 23 carried by the main arm 24 of the wrapping head 16. The belt is driven by motor 24. The belt and pulley may be replaced by a chain and sprocket arrangement.

As indicated above, the reel 13 is advanced by the loading conveyor 15 in the direction of arrow C in FIG. 4 until the leading edge of the reel 13 breaks a photoelectric beam 25 which is adapted to stop the loading conveyor 15. A beam 26 may be used to slow the conveyor prior to it stopping.

Figure 5:
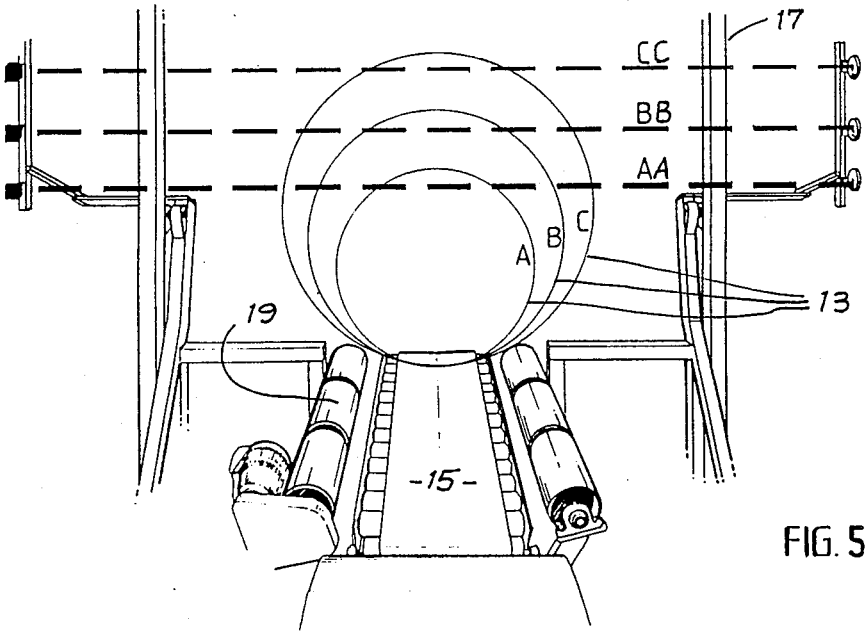

The reel 13 is identified by its diameter (see FIG. 5). In this instance, the machine is arranged to identify three different reel diameters A, B and C. Three photoelectric beams AA, BB and CC which are arranged above the conveyor 15 are broken by reels having diameters A, B and C respectively.

The mechanism utilized to tilt the support frame 17 is shown in FIG. 6. A photo-electric beam 27 senses the front end 28 of the reel 13 and is then traversed in the direction of arrow D to sense the rear end 29 of the reel 13. During travel of the beam 27, the shaft 30 is rotated by motor 31 and a pinion 32 on the end of the shaft 30 moves the rack 33 in the direction of arrow E to tilt the frame 17 about its fulcrum 34 so that its upper end moves in the direction of arrow F.

The angle of tilt (i.e. the angle between the wrapping plane and the axis of the reel) depends, inter alia, on the reel length and on reel diameter. The correct angle of tilt for a particular length of reel is determined by the manner in which the light beam 27 is moved along the reel 13. Shaft 35 is driven by chain 26 which in turn is driven by shaft 30.

Mounted on the shaft 35 is an eccentric plate 37 which carries an array of pegs 38 that guide a wire 39 attached to bar 40. A counter-weight 41 is also connected to the bar 40 so as to maintain tension on the wire 39. The bar 40 is arranged to move the beam 27 along the reel at a speed which varies according to the manner in which the wire 39 unwinds from the pegs 38. The beam 27 is generated by cell 42 which receives its power through cord 43 that enters junction box 44.

The mechanism for raising the reel 13 to the correct height according to its diameter so that every reel will rotate about the same axis is shown somewhat schematically in FIG. 7. In its initial position (shown as dotted outline), the diameter of the reel is sensed as described above. The tong arrangement 45 carries the drive rollers 19 and idler rollers 46. An elevating mechanism (not shown) operates on the tong arrangement 45 to raise the roller 19 and 46 into engagement with the reel 13 and then to lift the reel 13 to the required height.

The wrapping head 16 is shown in detail in FIGS. 8 and 9. It will be appreciated that the system of conveyors 14, 15 and 20 restricts the travel of the wrapping head 16 to the extent that the head 16 must always be above the conveyor level. Consequently, when wrapping short reels at a high tilt angle, the path of the head is eccentric to the reel. As a result, it is necessary to incorporate some film take-up device to ensure that the film is continuously under tension.

The main arm 24 of the wrapping head 16 has a downwardly depending portion 47 which carries the reel 48 of film 18 to be wrapped. A brake roller 49 normally bears against the film 18 on the reel 48 and tension on the film 18 is maintained by a take-up roller 50 under the action of a cylinder and ram arrangement 51 connected between the main arm portion 47 and roller carrier arm 52. After passing around the take-up roller 50, the film passes around an idler roller 53 adjacent to the film reel 48.

The wrapping process is shown in FIGS. 10 to 12. A film clamp (not shown) holding the free end of the film 18 is swung in towards the reel and holds the film close to the reel. Wrapping then commences at an initial tension and then at full film tension. Whilst the wrapping head is being rotated in the direction of arrow X, the reel 13 is rotated in the direction of arrow Y so that the film 18 travels in the direction of arrow Z. The initial runs 1 to 6 of the film are shown in FIG. 11 and the fully wrapped reel (with its core clear of film) in FIG. 12.

After one revolution of the wrapping head, the rollers 19 are rotated to turn the reel 13 slowly. Wrapping continues as programmed to completion when the wrap arm 24 is slowed and then stopped. The film is then clamped and cut. The reel is lowered on to the conveyor 15 and the wrapping head 16 is tilted to its rest (i.e. maximum tilt) position.

Various modifications may be made in details of design and construction without departing from the scope and ambit of the invention. For example, the angle of tilt could be adjusted by an electronic device adapted to convert the length of the reel as measured to the appropriate angle of tilt of the wrapping head.

I claim:

1. A machine for wrapping an elongated object said machine comprising:

(i) means for loading the object so that its longitudinal axis is placed on an axis of rotation on the machine, (ii) means for rotating the object about the axis of rotation, (iii) a rotating wrapping head adapted to wind wrapping material endwise about the object, (iv) means for tilting the wrapping head so that the endwise wrapping takes place in a plane at an angle of tilt to the axis of rotation of the object;

(v) means for measuring the length of the reel to be wrapped; and (vi) means for translating the measured length into said angle of tilt of the wrapping head;

2. A wrapping machine according to claim 1 wherein a length dimension of the reel is measured by a traveling photo-electric system that is controlled by a cam so that its motion is not linear.

3. A wrapping machine according to claim 1 wherein the wrapping head includes a wrapping material reel and means for maintaining tension of wrapping material delivered from the wrapping material reel to the object to be covered.

4. A wrapping machine according to claim 3 wherein the tensioning means includes a take-up roller mounted on a carrier arm pivotally mounted on the wrapping head and a cylinder and ram arrangement between the carrier arm and the remainder of the wrapping head.

5. A wrapping machine according to claim 1 and further including means for sensing the height of the object to be wrapped and means for elevating the object so that its longitudinal axis is in alignment with the axis of rotation.

6. A wrapping machine according to claim 5 wherein the elevating means includes a tong arrangement which carries the means for rotating the object.

7. A method of wrapping an object having a central core, said method including the steps of applying a wrapping material from a wrapping head in a plane inclined to the axis of the reel;

rotating the reel about its axis so that the wrapping material covers the external surface and ends of the reel except for the central core;

tilting said wrapping head so that endwise wrapping takes place in a plane at an angle of tilt to the axis of rotation of said object;

determining the length of the reel;

translating the measured length into said angle of tilt of the wrapping plane.

* * * * *